United States Patent [19]

Ueda et al.

[11] Patent Number: 4,457,276

[45] Date of Patent: Jul. 3, 1984

[54] IDLING SPEED CONTROL SYSTEM FOR INTERNAL COMBUSTION ENGINE

[75] Inventors: Tadakazu Ueda, Hiroshima; Kazumichi Tutumi, Himeji, both of Japan

[73] Assignees: Toyo Kogyo Co., Ltd., Hiroshima; Mitsubishi Denki Kabushiki, Tokyo, both of Japan

[21] Appl. No.: 433,627

[22] Filed: Oct. 8, 1982

[30] Foreign Application Priority Data

Oct. 9, 1981 [JP] Japan ..... 56-161167

[51] Int. Cl.[3] ..... F02D 9/02

[52] U.S. Cl. ..... 123/339; 123/340; 123/349

[58] Field of Search ..... 123/339, 340, 349, 353; 235/150.2; 180/105 E

[56] References Cited

U.S. PATENT DOCUMENTS 4,297,978 11/1981 Matsui ..... 123/340
4,344,398 8/1982 Ikeuru ..... 123/339
4,367,708 1/1983 Nakamuru et al. ..... 123/339
4,380,979 4/1983 Takase ..... 123/340
4,399,789 8/1983 Fano ..... 123/339

FOREIGN PATENT DOCUMENTS 55-98628 7/1980 Japan ..... 123/339

*Primary Examiner*—Raymond A. Nelli
*Attorney, Agent, or Firm*—Gerald J. Ferguson, Jr.; Joseph J. Baker

[57] ABSTRACT

Feedback control is carried out to maintain the idling speed of an internal combustion engine at a desired idling speed determined according to the operating conditions of the engine. When the actual idling speed of the engine significantly falls with respect to the desired idling speed for some reason, the amount of the intake air is increased by a large amount, while when the rotational speed falls to a small extent with respect to the desired idling speed, the amount of the intake air is increased little by little.

7 Claims, 10 Drawing Figures

IDLING SPEED CONTROL SYSTEM FOR INTERNAL COMBUSTION ENGINE

BACKGROUND OF THE INVENTION

1. Field of the Invention

This invention relates to an idling speed control system for an internal combustion engine.

2. Description of the Prior Art

Generally it is preferred to maintain the idling speed of the internal combustion engine of a vehicle at a low speed of about 600 to 700 rpm from the viewpoint of fuel consumption and stability of the combustion in the engine. Thus, there have been known various idling speed control systems in which an actuator for controlling the opening angle of the throttle valve is provided and the actuator is controlled according to the difference between the actual idling speed and a desired idling speed determined according to the operating conditions of the engine such as the temperature of the cooling water and whether or not a cooler is in operation so that the actual idling speed is equalized to the desired idling speed. Further, when the rotational speed of the engine abruptly falls below a certain value for some reason, there arises the possibility of the engine's stalling. In Unexamined Japanese Patent Publication No. 55(1980)-75547 is disclosed an idling speed control system for an internal combustion engine in which the amount of the intake air is increased by a certain amount to increase the rotational speed of the engine when the rotational speed thereof abruptly falls, thereby preventing stalling of the engine.

However, the idling speed control system of the Unexamined Japanese Patent Publication involves a problem that if an excessive amount of air is abruptly fed to the engine, overshoot is apt to occur and the rotational speed of the engine abruptly changes to adversely affect the feeling of the driver, though it is preferred to substantially increase the amount of the intake air to sharply increase the rotational speed of the engine in order to effectively prevent stalling of the engine.

SUMMARY OF THE INVENTION

In view of the foregoing observations and description, the primary object of the present invention is to provide an idling speed control system in which stalling of the engine can be effectively prevented without causing overshoot or adversely affecting the driver's feeling even if the rotational speed of the engine abruptly falls for some reason.

In accordance with the present invention, the amount of the intake air is increased by a large amount when the rotational speed of the engine is significantly lowered with respect to a desired idling speed, while when the rotational speed of the engine is lowered to a small extent with respect to the desired idling speed, the amount of the intake air is increased little by little.

DESCRIPTION OF THE PREFERRED EMBODIMENT

Figure 1:
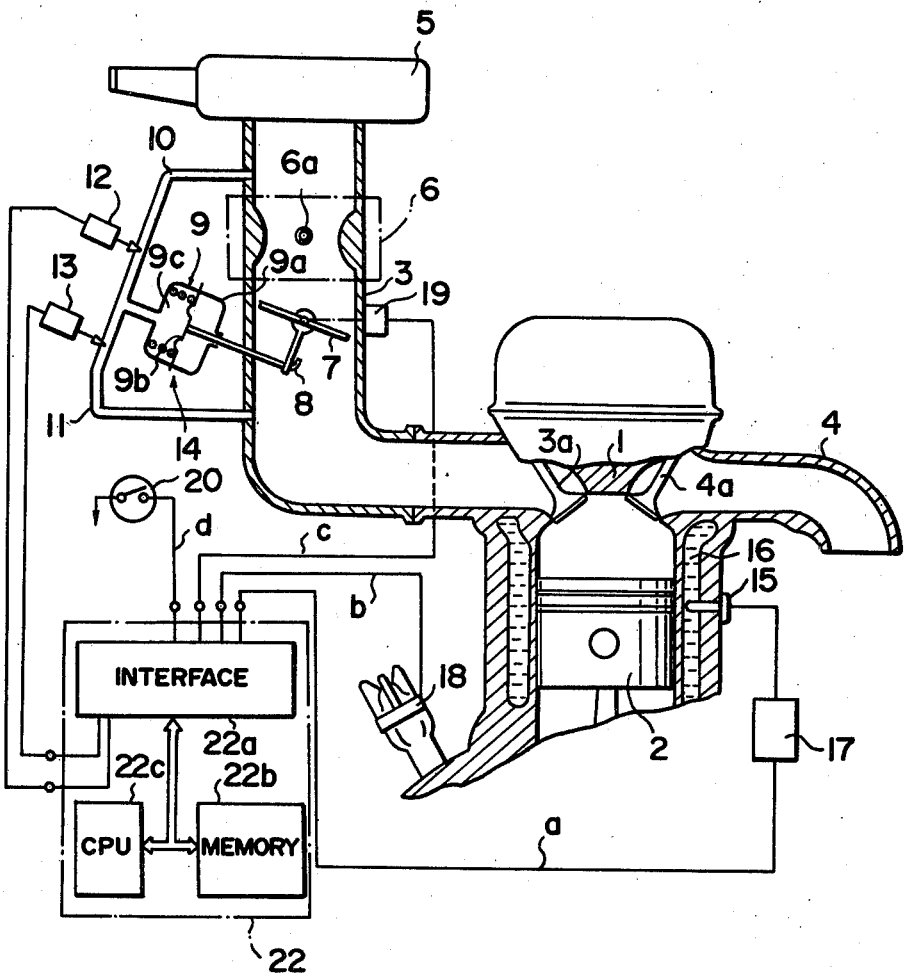
FIG. 1 is a schematic view of an internal combustion engine employing an idling speed control system in accordance with an embodiment of the present invention.

In FIG. 1 an internal combustion engine 1 has a piston 2, an intake manifold 3, an intake valve 3*a*, an exhaust manifold 4 and an exhaust valve 4*a*. On the top end of the intake manifold 3 is mounted an air cleaner 5 for filtering the air taken into the intake manifold 3, and a caburettor 6 is provided in the intake manifold 3 below the air cleaner 5. A fuel nozzle 6*a* of the caburettor 6 opens into the intake manifold 3. A throttle valve 7 is disposed just below or just downstream of the caburettor 6 to control the amount of air fed to the combustion engine 1. The throttle valve 7 is controlled by an actuator 14 including a stopper 8 which is engaged with the throttle valve 7 to open and close it. The stopper 8 is driven by a diaphragm unit 9 comprising a casing 9*a* and a diaphragm 9*b* which is mounted in the casing 9*a* to divide the internal space thereof into two chambers, whereby a vacuum chamber 9*c* is formed on the side of the diaphragm 9*b* remote from the stopper 8. The stopper 8 is connected to the diaphragm 9*b* at its end remote from the throttle valve 7 to move together therewith. A first passage 10 connects the vacuum chamber 9*c* to the space in the intake manifold 3 upstream of the throttle valve 7 which is substantially at atmospheric pressure, while a second passage 11 connects the vacuum 9*c* to the space in the induction manifold 3 downstream of the throttle valve 7 which is at a negative pressure. First and second solenoid valves 12 and 13 are provided to open and close the respective passages 12 and 13.

A water temperature sensor 15 detects the temperature of cooling water 16. The output of the sensor 15 is inputted into an A/D converter 17 which converts the analogue signal output of the sensor 16 into a digital signal. The output of the A/D converter 17, or a water temperature signal a is inputted into an interface 22*a* of an actuator controlling device 22 which will be described hereinbelow. A distributor 18 contains therein a rotational speed detector (an electromagnetic pick-up device) for detecting the rotational speed of the combustion engine 1 the output of which is inputted into the interface 22*a* of the actuator controlling device 22 as a rotational speed signal b. A throttle position sensor 19 detects the opening angle of the throttle valve 7 and delivers a throttle opening angle signal c to the interface 22*a*. A cooler load signal d which is the output of a cooler switch 20 is further inputted into the interface 22*a*.

The actuator controlling device 22 is in the form of a microcomputer comprising the interface 22*a*, a memory 22*b* and a CPU (Central Processing Unit) 22*c*, and compares the actual idling speed detected by the rotational speed detector with a desired idling speed which is determined according to the operating conditions of the engine 1 to determine a target opening angle of the throttle valve 7 according to the difference therebetween. At the same time, the actuator controlling device 22 compares the actual opening angle of the throttle valve 7 detected by the throttle position sensor 19 with the target opening angle of the valve 7 and controls the actuator 14 according to the difference therebetween so that the actual idling speed is equalized to the desired idling speed.

Figure 2:
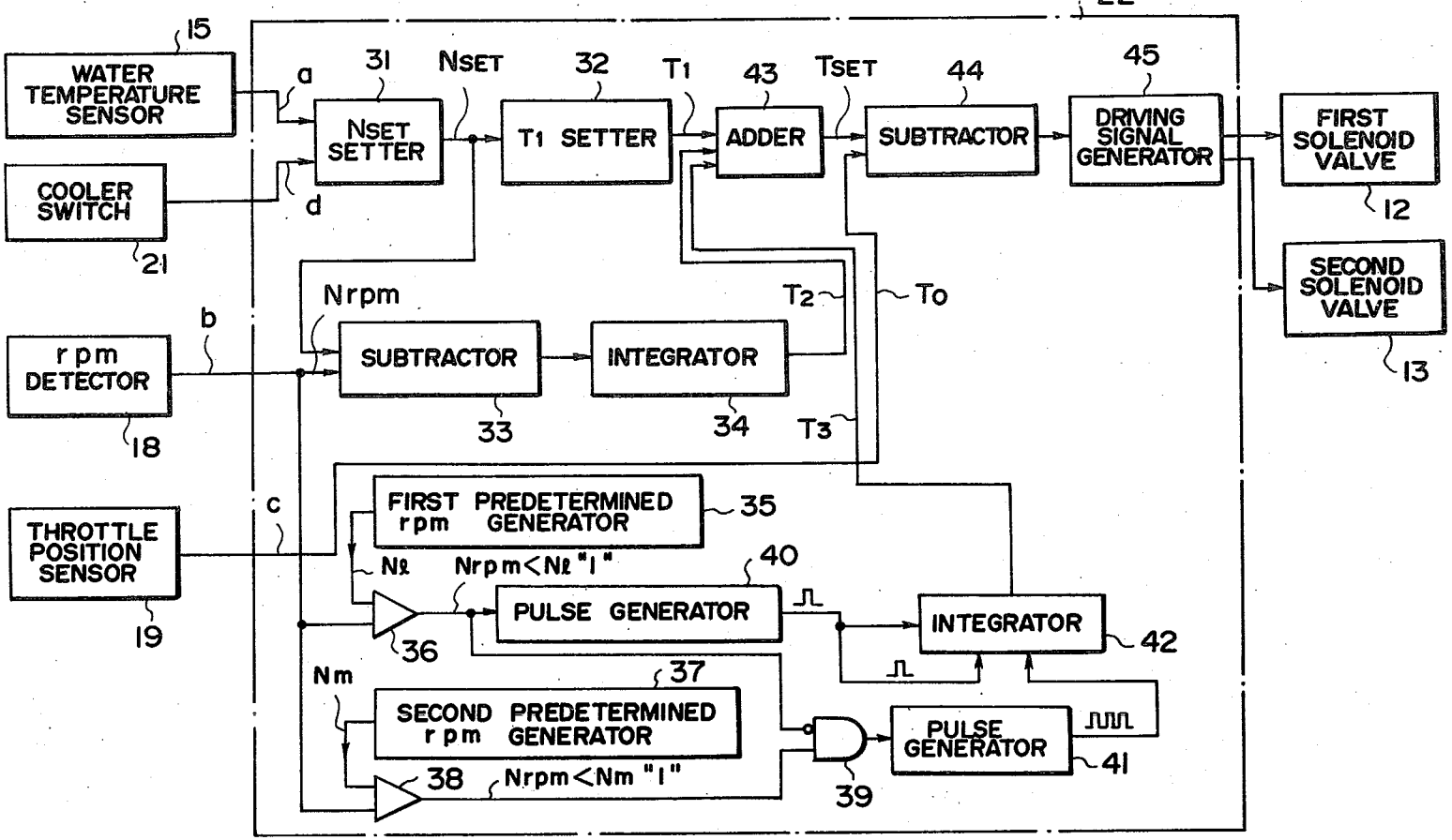
FIG. 2 is a block diagram of an example of an actuator controlling device which can be used in the idling speed control system of FIG. 1, FIG. 3(*a*) is a graph showing the relationship between the temperature of the cooling water and the desired idling speed in case of the embodiment of FIG. 1, FIG. 3(*b*) is a graph showing the relationship between the temporary target opening angle of the throttle valve and the desired idling speed, FIG. 3(*c*) is a graph showing the relationship between the duty ratio of the solenoid valve driving signal and the difference between the target opening angle of the throttle valve and the actual opening angle of the same.

FIG. 2 is a block diagram of an example of the actuator controlling device. In FIG. 2, like parts and like signals bear the same reference numerals or symbols as those in FIG. 1. The part surrounded by the chained line in FIG. 2 corresponds to the microcomputer in FIG. 1 as indicated at 22. A desired idling speed setter 31 determines a desired idling speed Nset according to the water temperature signal a and the cooler load signal d in accordance with the relationship shown in FIG. 3(*a*). A temporary target throttle angle setter 32 determines a temporary target opening angle T1 of the throttle valve 7 according to the desired idling speed Nset in accordance with the relationship shown in FIG. 3(*b*). The difference between the desired idling speed Nset and the actual rotational speed Nrpm detected by the rotational speed detector 18 is calculated by a first subtractor 33. An integrator 34 integrates the output of the first subtractor 33 to obtain a first correction term T2 for a target opening angle Tset with respect to the actual rotational speed Nrpm. A first predetermined rotational speed generator 35 generates an electric voltage representing a first predetermined rotational speed Nl lower than the desired idling speed Nset. A first comparator 36 compares the first predetermined rotational speed Nl with the actual rotational speed Nrpm and outputs "1" when the former is larger than the latter (Nl>Nrpm). A second predetermined rotational speed generator 37 generates an electric voltage representing a second predetermined rotational speed Nm which is higher than the first predetermined rotational speed Nl but lower than the desired idling speed Nset. A second comparator 38 compares the actual rotational speed Nrpm with the second predetermined rotational speed Nm and outputs "1" when the latter is larger than the former (Nm>Nrpm). The inverted signal of the output of the first comparator 36 and the output of the second comparator 38 are inputted into a pair of inputs of an AND gate 39, respectively. A first pulse generator 40 generates one pulse each time the first comparator 36 outputs "1". A second pulse generator 41 generates a plurality of pulses when receiving the output of the AND gate 39. Each time the output of the second pulse generator 41 is inputted into an integrator 42, the integrator 42 adds the output of the second pulse generator 41 to the previous output(s) of the same and outputs the sum of them, while when the output of the first comparator 40 is inputted into the integrator 42 as a control signal, the integrator 42 once clears its integral output and then integrates the output of the first comparator 40. An adder 43 sums the temporary target opening angle T1, the first correction term T2 which is the output of the integrator 34 and a second correction term T3 which is the output of the integrator 42 and generates a target opening angle Tset of the throttle valve. The second correction term T3 is for correcting abrupt fall of the rotational speed. A second subtractor 44 calculates the difference between the target opening angle Tset and the actual opening angle T0 of the throttle valve detected by the throttle position sensor 19. A driving signal generator 45 generates a pulse signal having a desired duty ratio for driving the solenoid valves 12 and 13 according to the output [Tset-T0] of the second subtractor 44 in accordance with the relationship shown in FIG. 3(*c*).

Now, operation of the control system of FIG. 1 will be described referring to FIG. 4 which shows a flow chart of operation of the CPU 22*c*.

In step S1, the CPU 22*c* sets both the correction terms T2 and T3 at 0 as an initial value. In step S2, the CPU 22*c* determines based on the throttle opening angle signal c and the rotational speed signal b whether or not the engine is idling, wherein it is determined that the engine is idling when the throttle valve 7 is in the idling position and at the same time the actual rotational speed of the engine is lower than a predetermined value. If NO, i.e., the engine is not idling, the CPU 22*c* repeats the step S2 until the engine comes to idle. When it is determined that the engine is idling, the CPU 22*c* proceeds to step S3. In the step S3, the CPU 22*c* detects the operating conditions of the engine by way of the cooler load signal d and the water temperature signal a. In step S4, the desired idling speed Nset is calculated according to the temperature of the cooling water and whether or not the cooler is in operation in accordance with the relationship shown in FIG. 3(*a*). As can be seen from FIG. 3(*a*), when the temperature of the cooling water is low, the desired idling speed Nset is set at a high value. This is because when the ambient temperature is low, idling cannot be stabilized unless the rotational speed of the engine is higher than a certain value. When the cooler is in operation, the desired idling speed Nset is set at a value higher than when the cooler is not in operation in order to assure the efficiency of the cooler, to reduce vibration of the engine and to assure that the dynamo can generate sufficient electric current operate the cooler.

Figure 3A:
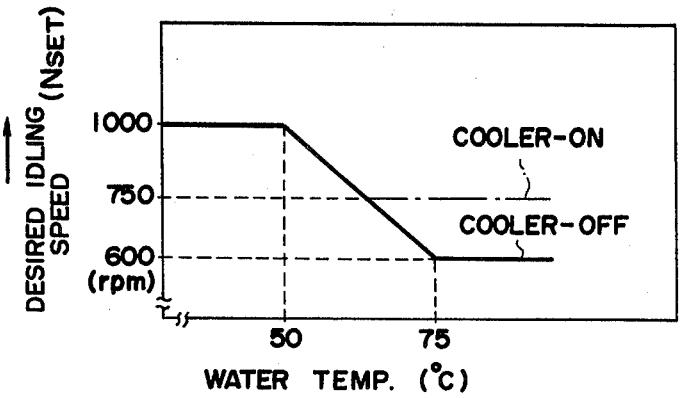
Figure 3B:
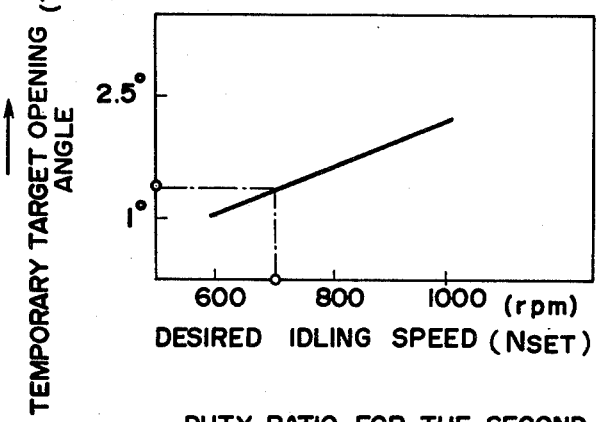
Figure 3C:
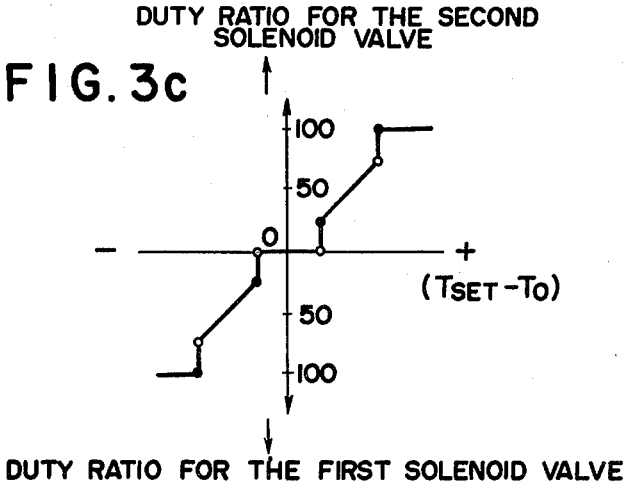

In the next step S5, the temporary target opening angle T1 of the throttle valve 7 corresponding to the desired idling speed Nset is obtained in accordance with the relationship shown in FIG. 3(*b*). In step S6 the actual rotational speed Nrpm of the engine is detected through the rotational speed signal b. In the step S7, the difference between the desired idling speed Nset and the actual rotational speed Nrpm is multiplied by a constant k to obtain the value of the first correction term T2 for the target opening angle Tset of the throttle valve 7, i.e., $T2=k\ (N\text{set}-N\text{rpm})$. When the CPU 22*c* repeats the entire flow chart of FIG. 4, the value of the previous first correction term is added to the value of the newly obtained first correction term, i.e., $T2=k(N\text{set}-N\text{rpm})+T2$. Thus, in this case, the sum T2 of the newly obtained first correction term T2 and the previous correction term is used as the value of the first correction term. In subflow S8, the value of the second correction term T3 is calculated in a manner to be decribed, and the temporary target opening angle T1, the value of the first correction term T2 and the value of the second correction term T3 are summed to obtain the target opening angle Tset is step S9. In step S10, the actual opening angle T0 of the throttle valve 7 is detected through the throttle opening angle signal c. Finally, in step S11, the difference between the target opening angle Tset and the actual opening angle T0 is calculated and a pulse signal having a duty ratio which is determined in accordance with the relationship shown in FIG. 3(*c*) according to the difference is outputted as the driving signal for the solenoid valves 12 and 13. In said subflow S8, it is determined whether or not the actual rotational speed Nrpm is lower than the first predetermined rotational speed Nl in step S81. If YES, the value of said second correction term T3 is set at a first predetermined value T3′ in step S82. Thereafter, the CPU 22*c* proceeds to the step S9. If NO, the CPU 22*c* proceeds to step S83 in which it is determined whether or not the actual rotational speed Nrpm is lower than the second predetermined rotational speed Nm. If YEs, the CPU 22*c* proceeds to step S84 in which a second predetermined value T3″ is added to the value of the second correction term T3 each time the step S84 is accomplished (T3=T3+T3″). Thereafter, the CPU 22*c* proceeds to the step S9. If NO is step S83, the CPU 22*c* immediately proceeds to the step S9.

Figure 4A:
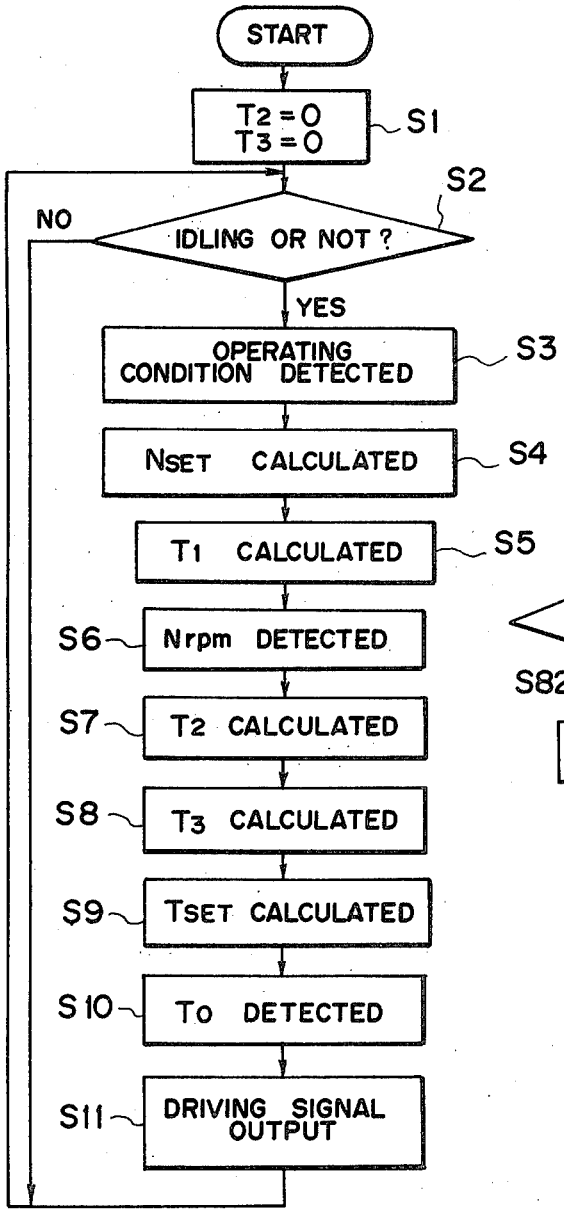
FIG. 4 is a flow chart of the CPU employed in the idling control system of FIG. 1.
Figure 4B:
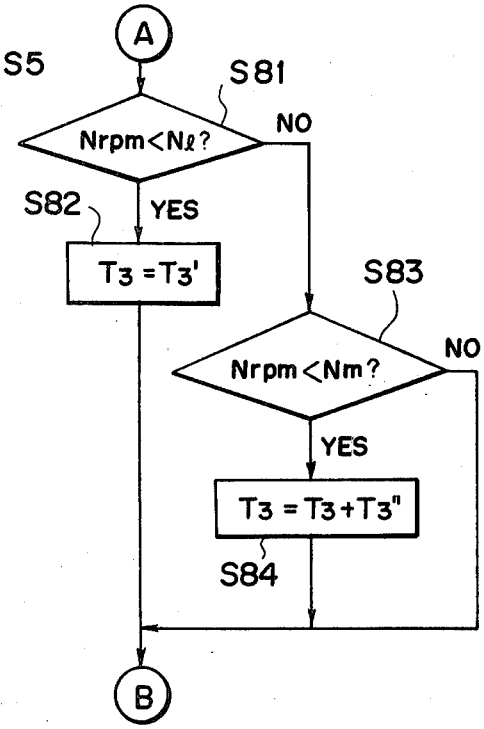

Generally, the CPU 22*c* repeats the entire processing shown in FIG. 4 at a rate of once in about 30 msec.

Now operation of the control system of FIG. 1 will be described referring to FIGS. 5 to 7.

Figure 5:
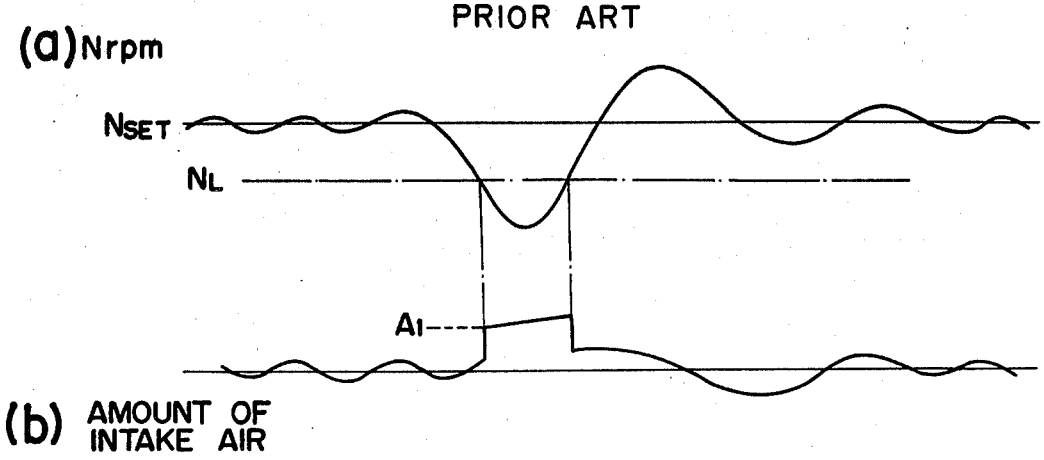
FIG. 5 PRIOR ART
FIG. 5 is a view showing change of the actual idling speed of the engine and the amount of the intake air in case of a prior art system.

FIG. 5 shows change of the rotational speed of the engine and the amount of the intake air in case of a prior art system in which the amount of the intake air is increased by a predetermined amount A1 at a stretch when the rotational speed Nrpm of the engine becomes lower than a predetermined rotational speed $N_L$ for some reason and as the result the rotational speed Nrpm is abruptly increased over the desired idling speed Nset.

Figure 6:
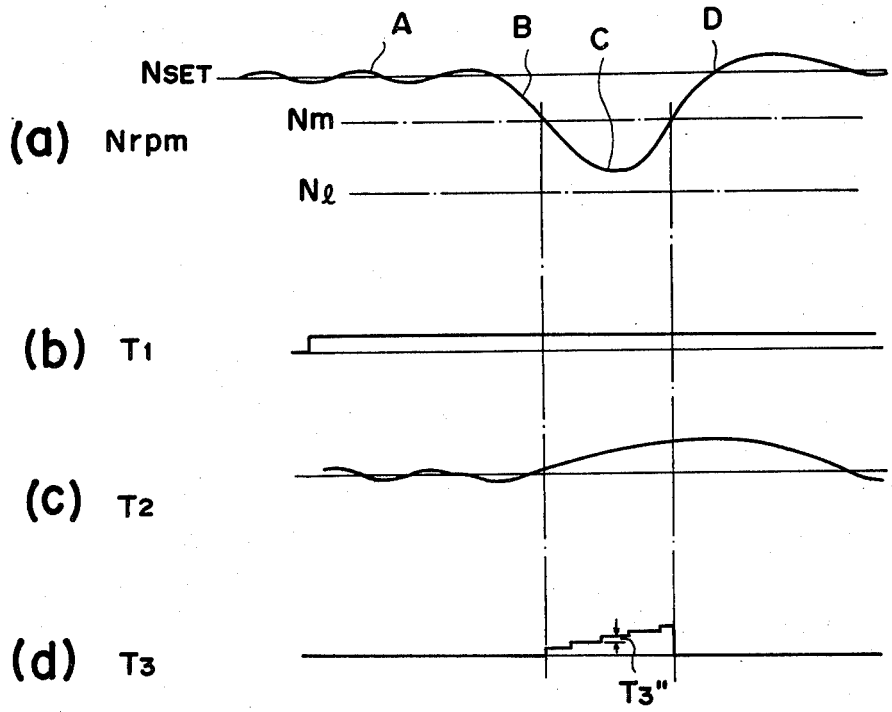
FIG. 6 is a view illustrating operation of the embodiment of FIG. 1 when the actual idling speed of the engine falls between a first and second predetermined values which are lower than the desired idling speed, the first predetermined value being lower than the second predetermined value.

FIGS. 6(*a*) to 6(*d*) show changes of the rotational speed, the temporary target opening angle T1, the value of the first correction term T2 for the target opening angle Tset and the value of the second correction term T3 for the same in case of the control system of FIG. 1, respectively, the sum of those three values T1, T2 and T3 being the target opening angle Tset. In region A in FIG. 6, the idling control is appropreately effected and accordingly the actual rotational speed Nrpm is held near the desired idling speed Nset. The temporary target opening angle T1 is maintained constant unless the water temperature and/or the condition of the cooler change, while the value of the first correction term T2 changes as the rotational speed of the engine changes, the direction of the change of the former being opposite to that of the latter. In the region A, the value of the second correction term T3 is set at 0. When the rotational speed Nrpm of the engine abruptly falls for some reason, the value of the first correction term T2 inclines to slightly increase in region B in which the rotational speed Nrpm is higher than the second predetermined rotational speed Nm but lower than the desired idling speed Nset (Nm<Nrpm<Nset). However, in region C in which the actual rotational speed Nrpm is between the first and second predetermined rotational speed Nl and Nm, i.e., Nl<Nrpm<Nm, the value of the first correction term T2 largely increases and at the time the value of the second correction term T3 gradually increases by the second predetermined value T3″ at a time. Thereby, the target opening angle Tset is substantially increased to increase the rotational speed Nrpm of the engine. When the rotational speed Nrpm subsequently becomes higher than the second predetermined value Nm as in region D, the value of the second correction term T3 is nullified and at the same time the value of the first correction term T2 is reduced as the rotational speed Nrpm increases. Accordingly, the actual rotational speed Nrpm cannot be substantially increased over the desired idling speed Nset and soon approaches to the desired idling speed Nset.

Figure 7:
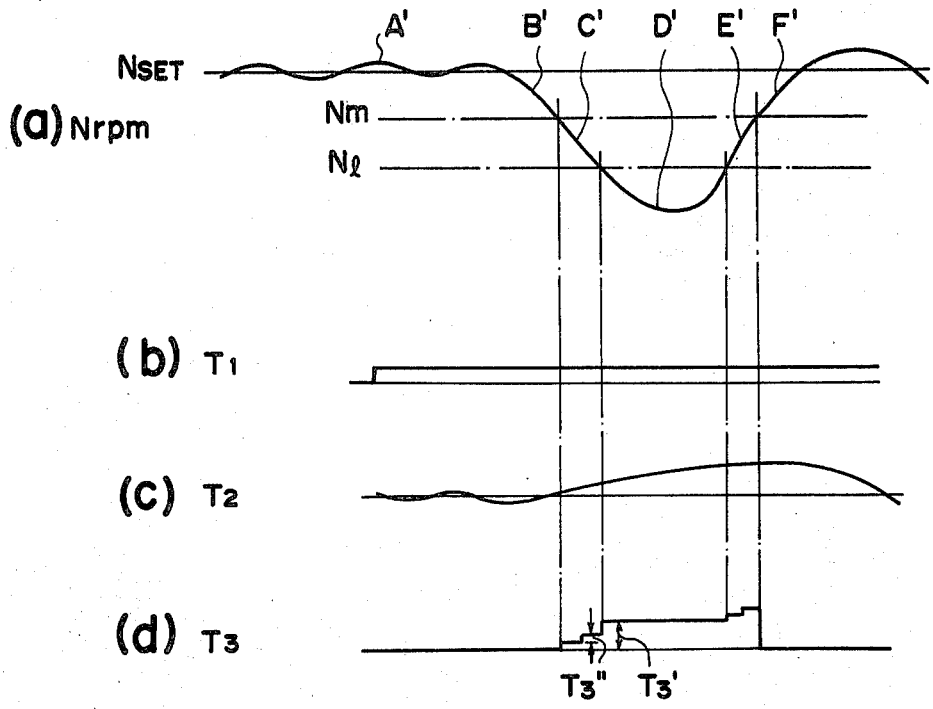
FIG. 7 is a view illustrating an example of the operation of the embodiment of FIG. 1 when the actual idling speed of the engine falls below the first predetermined value.

FIG. 7 is a view similar to FIG. 6 but when the actual rotational speed Nrpm falls below the first predetermined rotational speed Nl.

In regions A′, B′ and C′ in FIG. 7, the values of the first and second correction terms T2 and T3 change in a manner similar to their change in the regions A, B and C in FIG. 6. However, in region D′ in which the rotational speed Nrpm of the engine is lower than the first predetermined rotational speed Nl, the value of the second correction term T3 is set at said first predetermined value T3′ irrespective of its value before the rotational speed Nrpm becomes lower than the first predetermined rotational speed Nl, and is held at the first predetermined value T3′ over the entire D′ region. At the same time the value of the first correction term T2 is substantially increased. Therefore, the target opening angle Tset of the throttle valve becomes very large, whereby the rotational speed Nrpm of the engine is rapidly increased. When the rotational speed Nrpm becomes, as the result, higher than the first predetermined rotational speed Nl but lower than the second predetermined rotational speed Nm (Nl<Nrpm <Nm) as shown in region E′, the value of the second correction term T3 is gradually increased by adding at a time the second predetermined value T3″ to the value of the second correction term T3 in the region D′ which is equal to the first predetermined value T3′. When the rotational speed Nrpm of the engine further increases to be higher than the second predetermined rotational Nm as shown in region F′, the value of the second correction term T3 is nullified. When the rotational speed Nrpm of the engine becomes higher than the desired idling speed Nset as the result of setting the opening angle of the throttle valve at a large value, the first correction term T2 is reduced to restrain the rotational speed of the engine, whereby the rotational speed of the engine approaches the desired idling speed Nset. Thereafter, the idling speed control system of this embodiment again operates in the normal idling speed controlling condition.

In the idling speed control system of this embodiment, overshoot can be effectively prevented since when the rotational speed Nrpm falls to a relatively small extent, i.e., when Nl<Nrpm<Nm, the target opening angle Tset is gradually increased little by little. On the other hand, stalling of the engine can be effectively prevented by largely increasing the target opening angle Tset to rapidly increase the intake air when the rotational speed of the engine is significantly falls, i.e., below the first predetermined rotational speed Nl and the engine is apt to stall.

Figure 8:
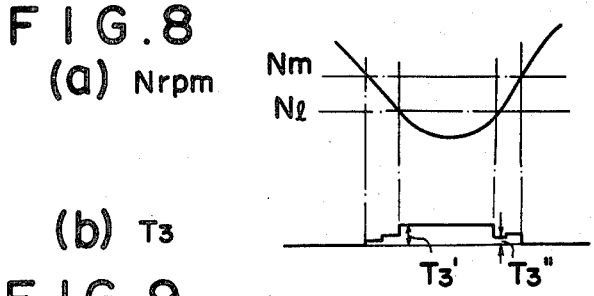
FIG. 8 is a view illustrating another example of the operation of the embodiment of FIG. 1.

Although in the above embodiment, the value of the second correction term T3 is set at the first predetermined value T3′ independent of its previous value when the rotational speed of the engine changes from the zone of Nl<Nrpm<Nm to the zone of Nrpm<Nl, while when the rotational speed of the engine changes from the zone of Nrpm<Nl to the zone of Nl<Nrpm<Nm, the value of the second correction term T3 is gradually increased by the second predetermined value T3″ at a time, and further when the rotational speed of the engine changes from the zone of Nl<Nrpm<Nm to the zone of Nm<Nrpm, the value of the second correction term T3 is nullified. However, as shown in FIG. 8 the value of the second correction term T3 may be once nullified and then gradually increased by the second predetermined value T3″ at a time when the rotational speed of the engine changes from the zone of Nrpm<Nl to the zone of Nl<Nrpm<Nm, and then when the rotational speed of the engine further changes to the zone of Nm<Nrpm, the second correction term T3 may be nullified, i.e., may be set at 0.

Figure 9:
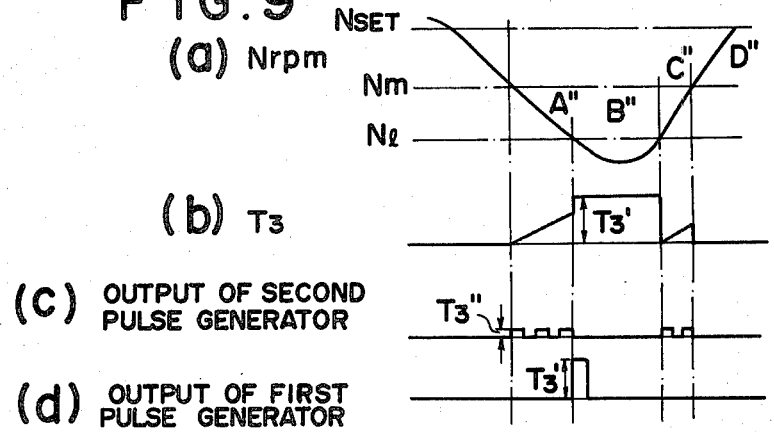
FIG. 9 is a view illustrating operation of the embodiment of FIG. 1 but the actuator controlling device of FIG. 1 is employed in stead of the microcomputer.

The operation of the actuator controlling device shown in FIG. 2 is substantially the same as the operation of the microcomputer described above. Therefore, only the change of the value of the second correction term T3 and the operation of the components related thereto will be described below referring to FIG. 9. In region A″ in which the rotational speed Nrpm of the engine is between the first and second predetermined rotational speeds Nl and Nm, i.e., Nl<Nrpm<Nm, the second pulse generator 41 generates a plurality of pulses having a hight corresponding to the second predetermined value T3″ at a predetermined frequency, and the integrator 42 integrates the pulses, whereby the value of the second correction term T3 gradually increases with a predetermined inclination. In region B″ in which the rotational speed Nrpm of the engine becomes lower than the first predetermined rotational speed Nl, i.e., Nrpm<Nl, the first pulse generator 40 generates a single pulse having a hight corresponding to the first predetermined value T3′, and the integrator 42 once clears the previous value of the second correction term T3 and then integrates the single pulse. Therefore, the value of the second correction term T3 in the region B″ is equal to the first predetermined value T3″. In region C″ in which the rotational speed Nrpm of the engine becomes higher than the first predetermined rotational speed Nl but lower than the second predetermined rotational speed Nm, i.e., Nl<Nrpm<Nm, the second pulse generator 41 again generates a plurality of pulses having a hight corresponding to the second predetermined value T3″ at the predetermined frequency, and the integrator 42 once nullifies the value of the second correction term T3 in the region B″ and then integrates the pulses generated by the second pulse generator 41. Accordingly the value of the second correction term T3 gradually increases with the predetermined inclination. Further, the value of the second correction term T3 is nullified and held at 0 in region D″ in which the rotational speed Nrpm becomes higher than the second predetermined rotational speed Nm, i.e., Nrpm>Nm.

Further, in the above embodiment the deviation of the actual rotational speed from the desired idling speed is reflected in the deviation of the actual opening angle of the throttle valve from the target opening angle and the feedback control is carried out to equalize the actual opening angle to the target opening angle. However, the present invention can also be applied to a system in which feedback control is not carried out with respect to the opening angle of the throttle valve and feedback control is carried out with respect only to the rotational speed of the engine.

Further in the above embodiment, the idling speed is controlled by controlling the opening angle of the throttle valve. However, the present invention can be applied to a system in which the idling speed is controlled by controlling the flow of air through a bypass passage bypassing the throttle valve.

Figure 10:
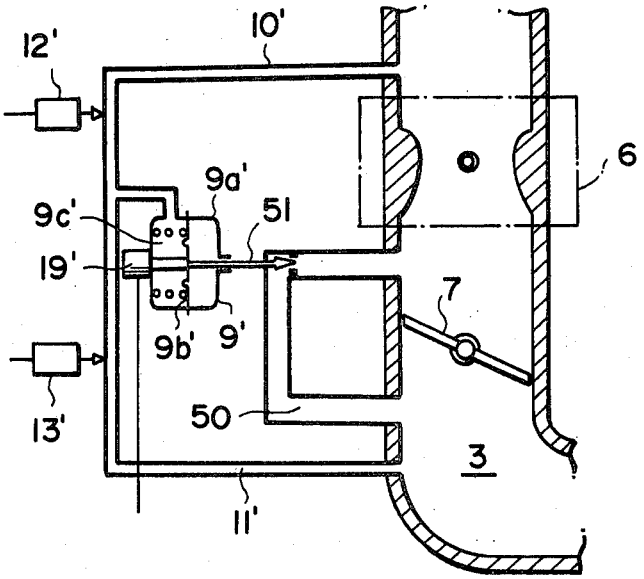
FIG. 10 is a schematic view showing a part of an idling speed control system in accordance with another embodiment of the present invention.

In FIG. 10, a bypass passage 50 is provided so that one end thereof opens into the intake manifold 3 between the caburretor 6 and the throttle valve 7, and the other end thereof opens into the intake manifold 3 downstream of the throttle valve 7. A bypass valve 51 is provided in the bypass passage 50 to open and close the bypass passage 50 to control the amount of the air flowing therethrough. The bypass valve 51 is controlled by a diaphragm device 9′ which is substantially the same as the diaphragm device 9 in FIG. 1 in it structure and includes a casing **9*a*′, diaphragm 9*b*′ and a vacuum chamber 9*c*′. A first passage 10′ connects the vacuum chamber 9*c*′ to the space upstream of the caburretor 6 in the intake manifold 3, while a second passage 11′ connects the vacuum chamber 9*c*′ to the space downstream of the throttle valve 7 in the induction manifold 3. First and second solenoid valves 12′ and 13′ are provided to open and close the first and second passages 10′ and 11′, respectively. Further, a position sensor 19′ is provided to detect the position of the bypass valve 51. This system can be controlled in a manner identical to that of the system of FIG. 1 and the signals taken out from or fed to the position sensor 19′ and solenoid valves 12′ and 13′ may be identical to those taken out from or fed to the position sensor 19 and solenoid valves 12 and 13 in FIG. 1**, respectively.

We claim:

1. An idling speed control system for an internal combustion engine having an intake system, a throttle valve disposed therein and an exhaust system comprising, a rotational speed detecting means for generating a rotational speed signal representing the rotational speed of the engine, an actuator means for controlling an adjusting valve which controls the amount of the intake air to be fed to the engine to control the rotational speed of the engine during idling, and a control circuit which receives the rotational speed signal and includes a comparing means for comparing the actual rotational speed detected by the rotational speed detecting means with a desired idling speed determined according to the operating conditions of the engine to output the result of the comparison; a first signal generator for generating a first signal for gradually increasing the amount of the intake air to be fed to the engine as the time lapses; a second signal generator for generating a second signal for controlling the amount of the intake air to be fed to the engine according to the output of the comparing means so that the actual rotational speed of engine is equalized to the desired idling speed; a third signal generator for generating a third signal for feeding a predetermined amount of the intake air to the engine; and a driving signal generating means for generating a driving signal for driving said actuator means, the driving signal generating means being adapted to output at least said first signal as the driving signal when the actual rotational speed of the engine is higher than a first predetermined rotational speed but lower than a second predetermined rotational speed which is lower than the desired idling speed, to output at least said third signal as the driving signal when the actual rotational speed is lower than the first predetermined rotational speed, and to output the second signal as the driving signal when the actual rotational speed is higher than the second predetermined rotational speed.

2. An idling speed control system as defined in claim 1 in which said driving signal generating means outputs the sum of the first and second signals as the driving signal when the actual rotational speed of the engine is higher than the first predetermined rotational speed but lower than the second predetermined rotational speed, while outputs the sum of the second and third signals as the driving signal when the actual rotational speed is lower than the first predetermined rotational speed.

3. An idling speed control system as defined in claim 1 further comprising a valve position sensor which detects the actual position of said adjusting valve to generate a valve position signal in which said driving signal generating means includes, a temporary target valve position setting means for generating a signal representing a temporary target position of said adjusting valve which is temporarily selected to obtain said desired idling speed, a target valve position setting means for generating a target valve postion signal representing a target position of said adjusting valve, the target valve position signal being obtained by adding the second signal to the output signal of the temporary target valve position setting means when the rotational speed of the engine is higher than the second predetermined rotational speed, by adding the first signal to the output signal of the temporary target valve position setting means when the rotational speed of the engine is lower than the second predetermined rotational speed but higher than the first predetermined rotational speed, and by adding the third signal to the output signal of the temporary target valve position setting means when the rotational speed of the engine is lower than the first predetermined rotational speed, a valve position comparing means which compares the actual position of the adjusting valve with the target position of the same and outputs the result of the comparison, and a signal outputting means which outputs as said driving signal a signal for controlling the adjusting valve according to the output of the valve position comparing means so that the difference between the actual position and the target position of the adjusting valve is nullified.

4. An idling speed control system as defined in claim 3 in which said adjusting valve is said throttle valve.

5. An idling speed controlling system as defined in claim 4 in which said actuator means includes a stopper which engages with the throttle valve to open and close it, the throttle valve being urged to close the intake system and the minimum opening degree of the throttle valve being defined by the stopper, a diaphragm device having a diaphragm and a pressure chamber defined by the diaphragm, said stopper being connected to the diaphragm to be moved together with the diaphragm according to the pressure chamber, and a solenoid valve which controls the pressure in the pressure chamber of the diaphragm device under control of said driving signals.

6. An idling speed controlling system as defined in claim 3 in which said adjusting valve is a bypass valve disposed in a bypass provided to bypass the throttle valve in the intake system.

7. An idling speed controlling system as defined in claim 6 in which said actuator means includes a connecting member which is connected with the bypass valve to open and close it, a diaphragm device having a diaphragm and a pressure chamber defined by the diaphragm, said connecting member being connected to the diaphragm to be moved together with the diaphragm according to the pressure in the pressure chamber, and a solenoid valve which controls the pressure in the pressure chamber of the diaphragm device under control of said driving signals.

* * * * *